United States Patent [19]

Manko

[11] 4,080,891

[45] Mar. 28, 1978

[54] BALING PRESS

[75] Inventor: Nicholas L. Manko, Piqua, Ohio

[73] Assignee: The French Oil Mill Machinery Co., Piqua, Ohio

[21] Appl. No.: 681,611

[22] Filed: Apr. 29, 1976

Related U.S. Application Data

[62] Division of Ser. No. 540,800, Jan. 14, 1975, Pat. No. 3,965,814.

[51] Int. Cl.[2] ..... B30B 15/30

[52] U.S. Cl. ..... 100/215; 100/218

[58] Field of Search ..... 100/249, 218, 215, 190

[56] References Cited

U.S. PATENT DOCUMENTS

| | | | |
|---|---|---|---|
| 3,563,164 | 2/1971 | Carkhuff | 100/249 |
| 3,603,247 | 9/1971 | Price | 100/215 |
| 3,827,349 | 8/1974 | Gilman | 100/190 |

*Primary Examiner*—Billy J. Wilhite

*Attorney, Agent, or Firm*—Biebel, French & Nauman

[57] ABSTRACT

A baling press, having a cavity and a bolster for reciprocating in the cavity, uses replaceable cavity liners and bolster wear strips. These liners and wear strips can be replaced without disassembling the press by withdrawing the bolster from the cavity. Also disclosed is the use of a number of high volume pumps which are switched out of the hydraulic supply circuit as the bolster nears the end of its compression stroke so as to allow the use of relatively low power prime movers.

2 Claims, 7 Drawing Figures

GATE UP
8LS
6 CR
BALE OUT
2PS
2TD3
2 TD
HIGH PRESSURE DWELL
7CR1
4PL
G
HIGH
RAM OUT
9LS
CR
DWELL RELAY
4CR3
5CR1
6PB GATE UP
4SVB
OUT
1SVA
GATE UP
4CR4
5CR2
2SVA
REGEN.
1CR 1
2CR2
4CR2
4CR5
5CR3
6CR2
7PB GATE DOWN
1SVB
GATE DOWN
4CR6
RAM IN
8PB
3PS
3SVA
IN
3CR3
1CR2
4CR7
5CR4
4PS
4SVA
IN
6CR3
5PS
5SVA
IN
9PB RAM OUT
6SVA
IN
3CR4
5CR5
2SVB
RAM OUT
100
7CR2
10 LS DECELERATE-1
3SVB
OUT
11 LS
3CR5
DECELERATE-2
5SVB
OUT
60
4CR8
6CR4
12LS
1CR3
6SVB
RAM OUT 1"
OUT

BALING PRESS

This is a division of application Ser. No. 540,800, filed Jan. 14, 1975, now U.S. Pat. No. 3,965,814.

BACKGROUND OF THE INVENTION

This invention relates to a baling press used in compressing loose material into a predetermined size, and particularly to such a press which is useful in producing compressed bales of synthetic polymeric materials from loose tacky synthetic crumb. The use of hydraulic baling presses for this general purpose has been well known. However, whenever such a press is utilized as part of a continuously operating production facility, it is essential that maintenance repair or operations to the press be made as simple as possible in order to minimize down time of the entire facility. In particular, where certain parts of the press are subjected to wear due to friction, etc., it is desirable to provide wear strips and/or cavity liners that can be replaced without completely disassembling the press and machining these expensive parts. Available presses do utilize replaceable parts; however, insufficient attention has been given to the accessibility of these wear strips, or liner pieces, for replacement purposes. Thus, in many cases it is still necessary to disassemble the press partially in order to make a rather minor replacement of wear strips or of the liner for the press cavity.

Additionally, the size of the prime movers needed to power the hydraulic pumps used in such a baling press has presented a problem from the standpoint of expense. If it were desired to utilize a relatively low horsepower motor as a power source, a high pressure/low volume pump would have to be used. While such a pump is capable of supplying hydraulic fluid at the requisite high pressure, its low volume capacity makes high speed press operation impossible.

Another problem with prior art baling presses is their speed of operation. Typically the bolster performing compression of the crumb material reciprocates vertically. With such an arrangement the loose crumb material is loaded into the press cavity prior to compression through the same orifice used to discharge the compressed material. This "muzzle loading" technique requires a retractable chute to be used to supply the loose crumb material to the press cavity through the single orifice. The chute is then retracted so as to allow discharge of the compressed material. Such an arrangement unnecessarily complicates the press structure and slows press operation.

SUMMARY OF THE INVENTION

The present invention provides a baling press which incorporates replaceable wear strips around the face of the press bolster, and replaceable liner sections which form the surface of the press cavity and its loading chute. The face of the bolster, including the wear strips, is normally positioned at one end of the cavity, and the liner sections are bolted in place within the cavity and loading chute. According to the invention the drive ram for the bolster is so arranged that the bolster may be withdrawn from the cavity into a region of the press where the bolster face is exposed and the bolster wear strips can readily be replaced without any further disassembly operation of the press.

Furthermore, by withdrawing the bolster to this position, it is also possible to loosen the bolts positioning the liner sections in place, and withdraw these liner sections past the bolster face to the exterior of the press, and to substitute new liner sections, without any further disassembly of the press.

Additionally, the instant invention provides a baling press which utilizes a plurality of pumps and a plurality of prime movers, each pump being associated with a particular prime mover. Pressure sensing means are provided to disconnect each pump as its associated prime mover reaches a predetermined percentage of overload. A single high pressure/low volume pump driven by a relatively low horsepower prime mover is provided to maintain the high pressure required for maximum compression by the baling press. This arrangement allows for a high volume of fluid to be pumped at low pressure at the beginning of each compression cycle and thus provide for rapid operation of the press, while a low volume of fluid is pumped under high pressure at the end of each compression cycle.

The instant invention also provides a baling press having a supply opening which is separate from the discharge orifice. The means supplying material to be baled to the press cavity includes a selectively openable door covering the supply opening. The supply opening is located in the side wall of the press cavity such that substantial compression of the crumb material does not occur until the bolster has moved past the supply opening. The selectively openable door is therefore not subjected to forces produced during compression of the crumb material.

Accordingly, the present invention has for its objects the provision of an improved press construction which permits easy and rapid replacement of the bolster wear strips, and of the liner sections, without need to disassemble any major components of the press; to provide for high speed press operation by utilizing high volume pumps for the low pressure pumping and low volume pumps for high pressure pumping; and to utilize low horsepower prime movers and yet provide rapid press operation. A further object is the provision of a press having separate supply and discharge openings.

Other objects and advantages of the invention will be apparent from the following description, the accompanying drawings and the appended claims.

DETAILED DESCRIPTION OF THE INVENTION

Figure 1:
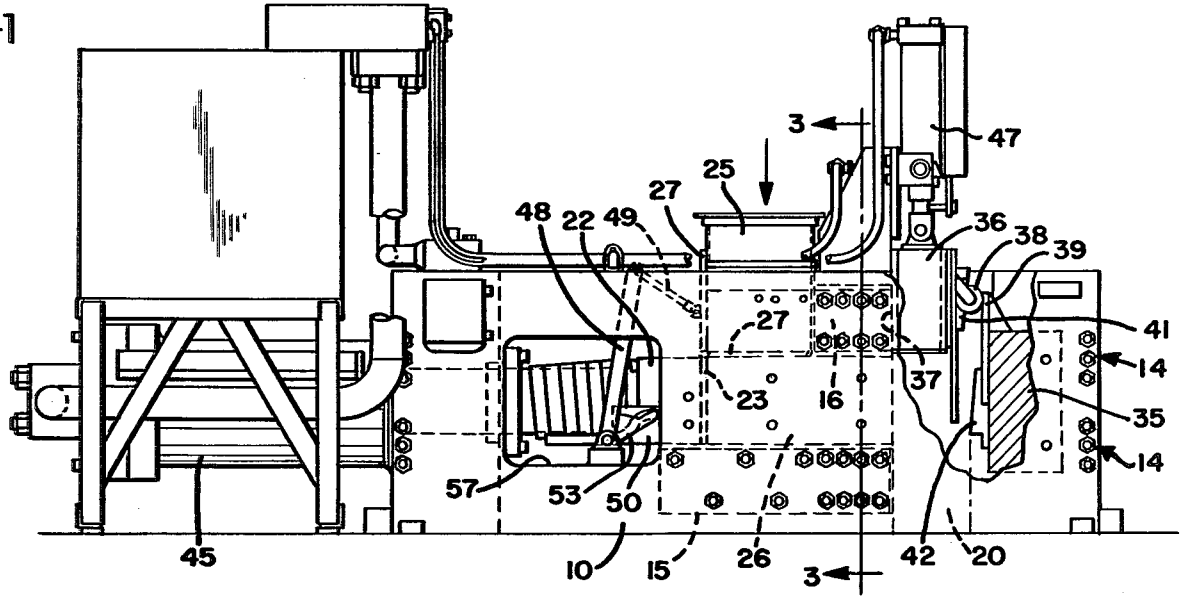
FIG. 1 is a side elevational view, with a portion broken away and shown in section, showing the major components of a typical baling press incorporating the features of the invention.
Figure 2:
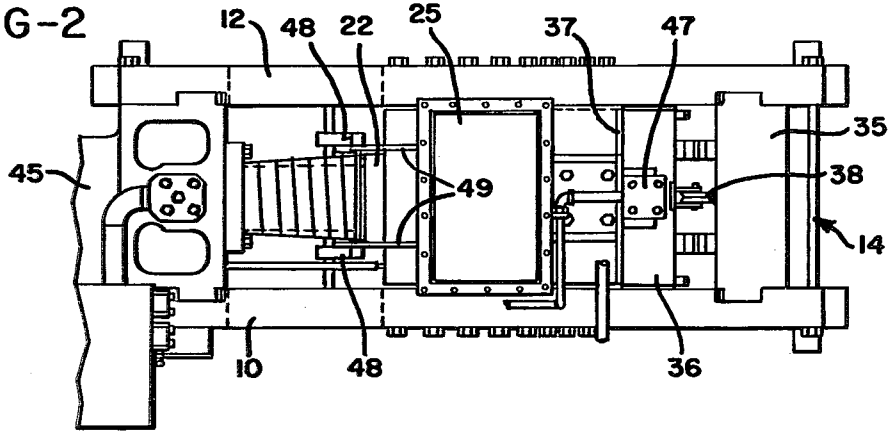
FIG. 2 is a plan view of the press as shown in FIG. 1.
Figure 3:
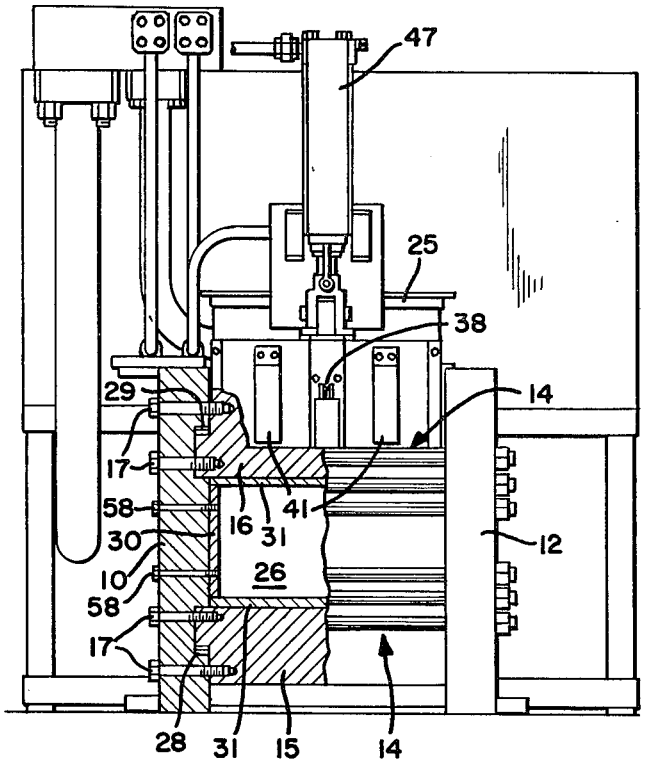
FIG. 3 is an end view, looking at the right hand end of the press shown in FIG. 1, with half of the view broken away to show interiorly of the press head, and with the side, top and bottom plates, and associated liner sections, shown in section.

Referring to the drawings, and particularly to FIGS. 1 and 3, the press structure consists of extended side plates 10 and 12 which are connected at opposite ends with a plurality of through bolts designated by the general reference numeral 14. A bottom plate 15 and a top plate 16 are held in place by additional studs 17, extending between the side plates and fitted thereinto as shown particularly in FIG. 3. As seen in FIG. 1, the bottom plate 15 extends from the bale discharge opening 20 between the side plates, rearwardly or to the left as seen in FIG. 1 to the retracted position of the bolster 22. In this position, the face 23 of the bolster is vertically aligned with the rearward edge of the inlet or feed chute 25, which communicates with the press cavity 26 through a pivoting door 27. The upper plate 16 is shorter, and extends from the plane of one edge of the discharge 20 rearwardly to the edge of the feed chute 25. Keys 28 and 29 are composed of longitudinally tapered strips. These keys are tapped into place after bolts 17 are tightened so as to exert an upward pressure on bottom plate 15 and a downward pressure on top plate 16. As a result, the replaceable liner pieces 30 lining the sides of cavity 26 are compressed between top and bottom liner pieces 31.

The press head 35 is supported between the side plates 10 and 12, spaced on the opposite side of the bale discharge 20, and a vertically movable cover or gate 36 is supported at the top of the discharge, capable of moving vertically from its open position, as shown in FIG. 1, to a closed position where one face 37 of the gate functions as an end wall of the cavity 26. Movement of the gate 36 is guided by roller 38 which operates in a track 39 that is supported on the center of the head 35. In addition, cooperating wedges 41, on the gate, and 42, on the head, are arranged to contact each other in the closed position of the gate, firmly supporting it against the thrust of material being compressed in the cavity by the movement of the bolster 22.

The bolster 22 is driven by a hydraulic ram which is shown at 45, and the gate 36 is operated by a doubleacting hydraulic cylinder 47. The door 27 is moved between its open and closed positions by the action of arms 48 which are pivoted to the side frame, one each side of the press, and connected to the door by links 49. Cams 50 move with the bolster, and followers (not shown) ride in these cams and are carried at the end of the short arms 53 which control the motion of the longer arms 48. It will be seen that forward motion of the bolster results in swinging closed the door 27, as the bolster is moved forward by ram 45 and begins to compress material loaded into cavity 26 through a feed chute.

In a normal cycle of operations, gate 36 is closed, the cavity is filled with material from the feed chute, and ram 45 moves the bolster 22 forward, initially closing door 27, and compressing the material within the cavity against the gate 36. The stroke of the ram is halted, by controls later described, when the material is compressed to the desired thickness within the end of the cavity at the gate 36. In the case of crumb synthetic polymers, the pieces are sufficiently tacky that they adhere together and form an essentially self-supporting block or bale. The gate is then withdrawn upwardly, and ram 45 moves the bolster further forward until its face 23 aligns with the edge of the cavity at the discharge 20. The gate 36 then is moved downwardly by cylinder 47, functioning to push the compressed block or bale of material through the discharge 20, and wiping it from the face of the bolster in the event there is any sticking of the bale to the face. This same motion again moves the gate to its closed position and the ram 45 withdraws the bolster to its starting position as shown in FIG. 1.

Figure 4:
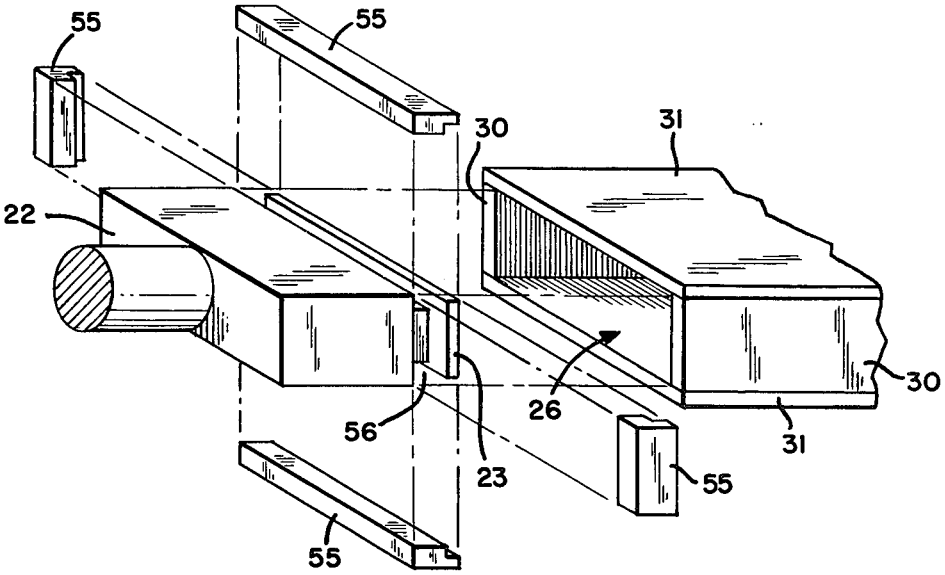
FIG. 4 is a schematic view illustrating the relationship of the replaceable bolster wear strips and cavity liner sections.

Referring now particularly to FIGS. 3 and 4, these show details of bolster 22 which compresses the polymeric material in cavity 26. Surrounding the forward face 23 of the bolster are wear strips 55 which are shaped so as to fit snuggly within groove 56. These wear strips typically are made of a fluorocarbon, for instance a polytetrafluoroethylene resin having an appropriate filler such as asbestos. A commerically available material actually used and found suitable is FLUOROGREEN which is manufactured by Fluorogreen Corporation, Houston, Tex. The cavity 26 is lined with replaceable liners 31 and 32 which typically are made of 1 inch thick, type 304 stainless steel. This arrangement of replacement liners and wear strips allows for simple maintenance and therefore minimizes the down time of the press.

Insertion of new wear strips is simply accomplished. The control circuitry for the ram is switched into a manual mode of operation and the bolster is withdrawn from the cavity 26, past its normally retracted position, into the space between access openings 57 in the side plates 10 and 12. The wear strips 55 are then easily replaced.

With the bolster withdrawn beyond its normally retracted position, the replaceable liners 30 and 31 are also accessible. For worn liners to be withdrawn from cavity 26, bolts 58 are first removed. Next the studs 17 are loosened slightly and the narrow ends of tapered keys 28 and 29 are tapped so as to relieve the pressure, exerted on the side liners by the upper and lower liners, which is a result of the wedging action of tapered keys 28 and 29. The worn wear liners are then withdrawn from the cavity and new liners inserted. Reassembly is accomplished by reinserting bolts 58 and tightening bolts 17. After new wear strips 55 and new replaceable liners 30 and 31 have been positioned properly the bolster 22 is reinserted into cavity 26.

Figure 5A:
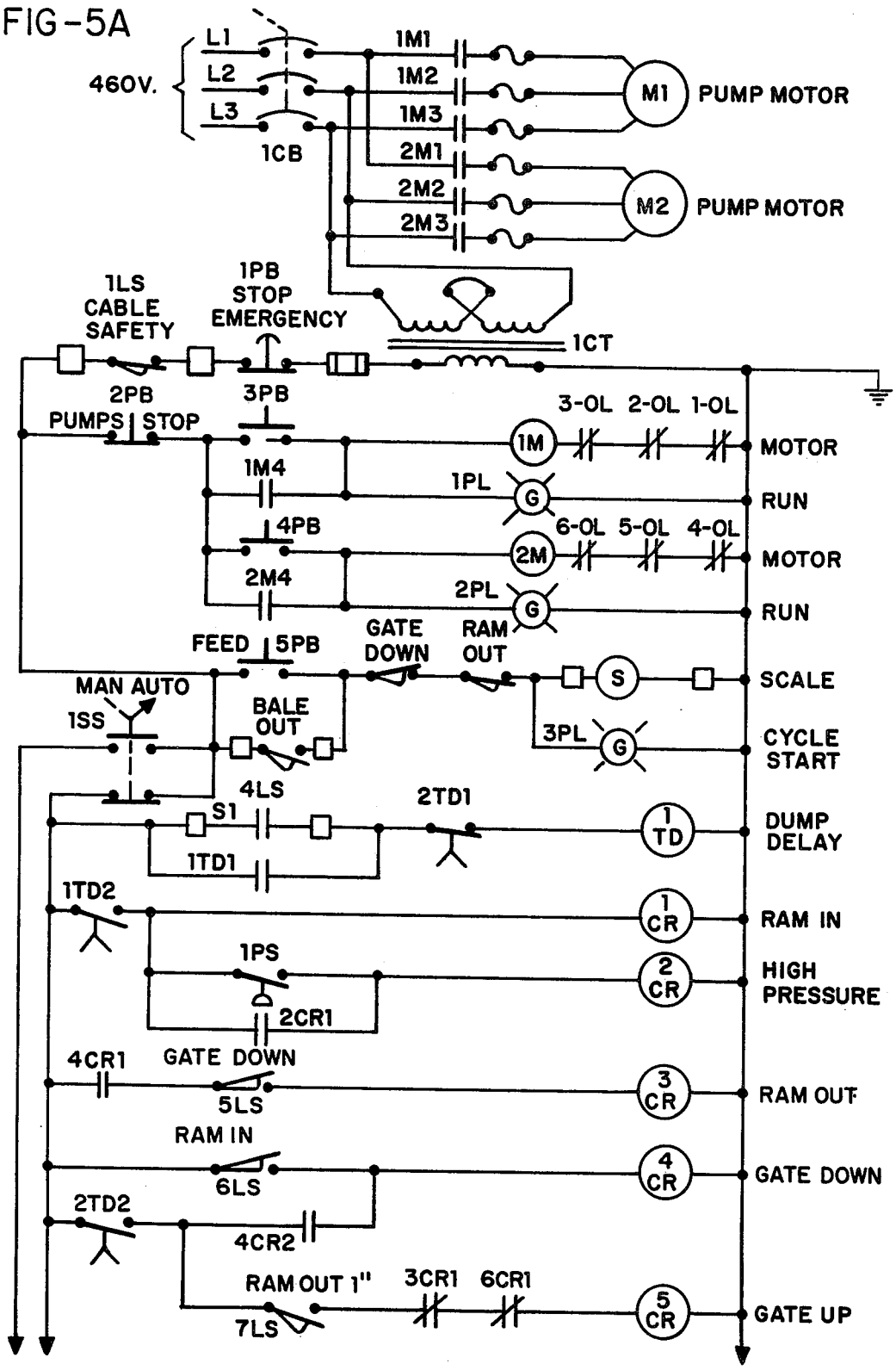
FIGS. 5A and 5B together illustrate schematically the electrical control circuitry of the preferred embodiment.
Figure 5B:
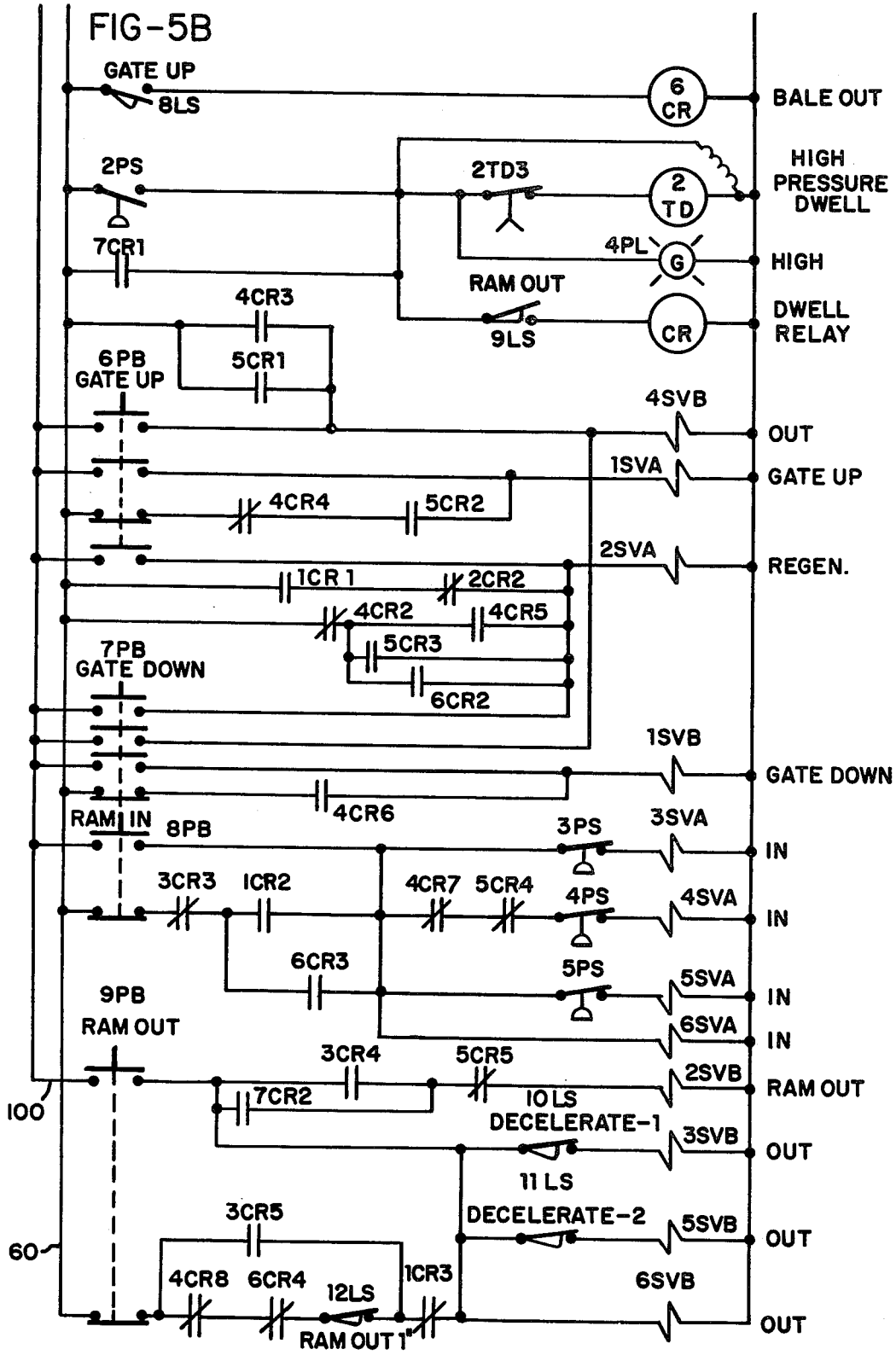
Figure 6:
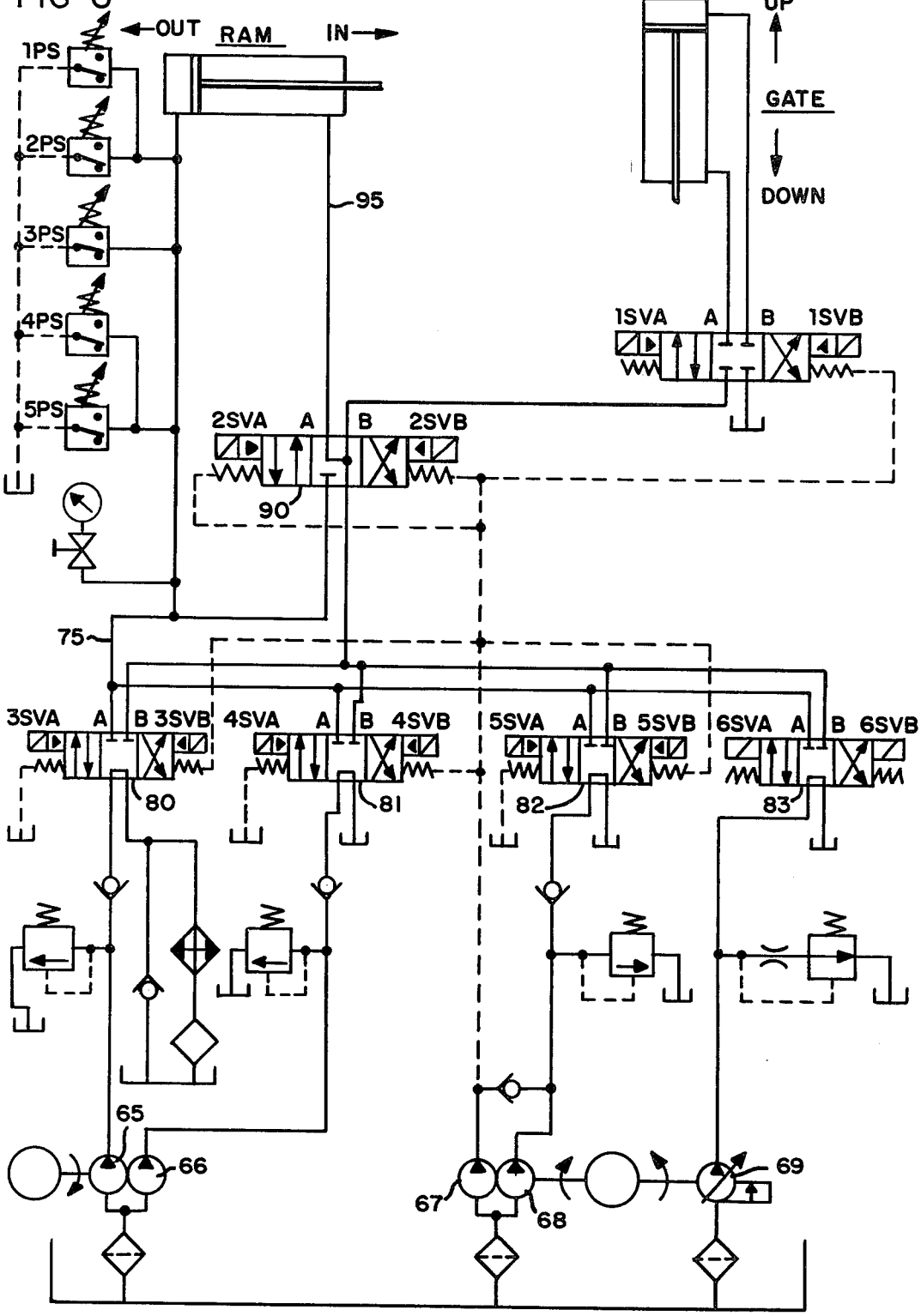
FIG. 6 shows the hydraulic circuit of the preferred embodiment.

Referring now to FIGS. 5A, 5B, and 6, there is shown the electrical and hydraulic circuitry which controls operation of the baler. It is necessary to discuss FIGS. 5 and 6 simultaneously in order to explain completely the operation of the preferred embodiment.

When set to automatic mode, the device functions in the following manner. Initially it is assumed the bolster is out, the lid is open, and gate 36 is in the down position. Selector switch 1SS is set in the automatic position with the result that line 60 is energized when the control panel circuit breaker 1CB is closed. Pump motors M1 and M2 are then activated by means of push button switches 3PB and 4PB. These switches activate solenoids 1M and 2M with the result that normally open contacts 1M1, 1M2, 1M3, 2M1, 2M2, and 2M3 are closed. Solenoids 1M and 2M then hold themselves on through normally open contacts 1M4 and 2M4. As long as the motors M1 and M2 are running, pilot lights 1PL and 2PL will be illuminated.

An ordinary operating cycle is then begun by depressing push button 5PB which initiates operation of the feed mechanism (not shown) to inlet 25. Coil S is energized resulting in normally open contacts S1 being closed. Pilot lamp 3PL signals this operation. The limit switch 4LS, which is appropriately located to sense discharge of a bale, will automatically initiate each successive cycle. When contacts S1 are closed, timer 1TD is activated and locked in through contacts 1TD1. The "ram in" relay 1CR is then activated through timing contact 1TD2 after a period of time sufficient for the loose synthetic crumb to fill cavity 30. Contacts 1CR2 will close and thus the coils of solenoids 3SVA, 4SVA, 5SVA, and 6SVA will be energized. Referring to FIG. 6 it can be seen that the result of this is to connect pumps 65, 66, 67, 68 and 69 to line 75 by way of valves 80, 81, 82, and 83. Further, normally open contact 1CR1 closes which enrgizes solenoid 2SVA and shafts the valve 90 such that a regeneration circuit is set up. Since the ram cylinder diameter may typically be 16 inches and ram shaft or rod diameter may typically be 11 inches, the force exerted by the hydraulic fluid on the blind side of the ram will exceed that exerted by the fluid on the shaft side. Fluid leaving the ram by way of line 95 will thus add to the fluid supplied by the pumps on line 75 to speed up ram movement. Normally closed contact 1CR3 is opened and thus any possibility of solenoid valves bucking the ram direction is prevented. The lid is closed in the first 6 inches of ram travel, as explained previously, by a mechanical linkage.

As pressure builds up, the pumps 65–68 are dropped out in sequence as 150% load on the motors is approached. This is accomplished by pressure sensitive switches 3PS, 4PS, and 5PS which are set at appropriate values to accomplish this sequence. Typical pressure settings would be 450 p.s.i. for 5PS, 900 p.s.i. for 4PS, and 1400 p.s.i. for 3PS. When the ram builds up to 3000 p.s.i., pressure switch 1PS closes and energizes high pressure relay 2CR. This in turn locks in relay 2CR through normally open contacts 2CR1. Normally closed contacts 2CR2 are then opened which drops out solenoid 2SVA, ending regeneration and permitting full force on the bale from the high pressure piston pump 69. Use of one low volume high pressure pump permits the high pressure pumping to be accomplished with a relatively low horsepower prime mover. Pressure switch 2PS also closes at 3000 p.s.i. energizing the "high pressure dwell" timer 2TD through contact 2TD3. This timer is adjustable to allow for compression of different materials having varying properties. The dwell relay 7CR is also energized and locks itself in through contact 7CR1. After a preset interval, timer 2TD times out and the timing motor stops as timing contact 2TD3 opens. Timing contact 2TD1 then opens, deenergizing relay 1TD. Timing contact 1TD2 resets and opens deenergizing relays 1CR and 2CR. This results in normally open contacts 1CR2 opening and 3SVA through 6SVA being deenergized. Normally open contact 1CR1 opens and prevents solenoid 2SVA from reenergizing as the normally closed contact 2CR2 closes.

Normally closed contact 1CR3 then closes and solenoids 2SVB, 3SVB, 5SVB, and 6SVB are energized. This of course shifts the direction of the ram as valves 80, 82, 83 and 90 shift into the B position. The ram is thus withdrawn until switch 12LS opens after one inch of travel. At the same time, limit switch 7LS closes and relay 5CR is energized. This results in the closing of normally open contact 5CR1 and the actuation of solenoid 4SVB. Thus valve 81 is shifted to its B position. Normally open contacts 5CR2 and 5CR3 in turn close and solenoids 1SVA and 2SVA are actuated. This results in application of hydraulic power to the rod end of the gate cylinder raising the gate 36 and opening the end of the cavity 26. Normally closed contacts 5CR4 and 5CR5 open and isolate solenoids 4SVA and 2SVB to prevent bucking.

When the gate is up, limit switch 8LS energizes solenoid 6CR with the result that contacts 6CR1 open, deenergizing relay 5CR and dropping out the "gate up" circuit. The 1SVA directional valve then centers, holding the gate 36 in the open position. Normally open contact 6CR2 closes energizing solenoid 2SVA, and normally open contact 6CR3 closes energizing solenoids 3SVA, 4SVA, 5SVA, and 6SVA. The ram then extends for a full stroke and ejects the bale from the cavity 26. Normally closed 6CR4 opens and isolates the "ram out" solenoids.

Limit switch 6LS is actuated as the ram is extended and the relay 4CR is thus energized. Normally open contact 4CR1 closes. Normally open contact 4CR3 closes and energizes solenoid 4SVB to provide power for closing the gate 36. Normally open contacts 4CR5 and 4CR6 also close and energize solenoids 2SVA and 1SVB, respectively, directing hydraulic fluid to the blind side of the gate piston and thus bringing gate 36 down. This pushes out any bale which may stick to the bolster and also closes the cavity 26 in preparation for the next cycle. Bucking is prevented by the opening of contacts 4CR4, 4CR7, and 4CR8.

Limit switch 5LS is closed as the gate 36 goes down and thus the relay 3CR is energized through previously closed contact 4CR1. Normally closed contacts 3CR1, 3CR2, and 3CR3 isolate the "gate up" and "ram in" solenoids to prevent bucking. Normally open contacts 3CR4 and 3CR5 are closed and thus energize solenoids 2SVB, 3SVB, 5SVB, and 6SVB. This admits hydraulic fluid to the rod side of main ram causing it to retract at full speed. As the ram approaches the retracted position, limit switches 10LS and 11LS open to decelerate the ram by dropping out valves 3SVB and 5SVB. The lid opens automatically through its linkage.

At the retracted position limit switch 9LS opens and deenergizes relay 7CR. The timer 2TD is then reset as contact 7CR1 opens and the clutch coil is deactivated. Contact 2TD1 then closes and contact 2TD2 then opens in preparation for the next cycle. Relay 4CR is deenergized which in turn deenergizes relay 3CR by opening contacts 4CR1. This completes one cycle of operation. The next cycle is initiated by limit switch 4LS which is closed as the compressed bale leaves the baler.

As mentioned previously, replacement of the bolster wear strips and cavity liners is accomplished by retraction of the ram under manual control beyond its normal retracted position. The selector switch 1SS is set to manual, thus energizing line 100. The various press functions can now be accomplished by depressing the appropriate push buttons and holding them in for the desired length of time. The ram is controlled by pushing buttons 8PB and 9PB while the gate 36 is controlled by push buttons 6PB and 7PB. Retraction of the ram is accomplished by actuating switch 9PB. Solenoid 6SVB is then energized with the result that the ram may be moved back a sufficient distance for the replacement of the wear strips and cavity liners.

While the form of apparatus herein described constitutes a preferred embodiment of the invention, it is to be understood that the invention is not limited to this precise form of apparatus, and that changes may be made therein without departing from the scope of the invention.

What is claimed is:

1. A baling press for compressing material to be baled, such as loose crumb polymeric material, comprising:

a bolster for reciprocating between a retracted position and an advanced position, means forming a cavity within which said bolster reciprocates, said means defining cavity walls surrounding said bolster defining two dimensions of a bale and extending between the advanced and retracted positions of said bolster, means defining a discharge orifice at the end of said cavity spaced beyond the advanced position of said bolster by an amount corresponding to the third dimension of a bale and through which the baled material is discharged by movement of said bolster beyond said advanced position, movable means for closing said discharge orifice to provide a surface against which said bolster compresses said material when in said advanced position, means for moving said movable means in a direction perpendicular to the direction of movement of said bolster to open said discharge orifice at the end of said cavity permitting discharge of said baled material after said baled material is compressed within said cavity and to close said discharge orifice and wipe the bolster free of the baled material after said baled material is discharged, and means for supplying material to be baled to said cavity, including a supply opening into said cavity which is located adjacent the retracted position of said bolster such that substantial compression of said material does not occur until said bolster has moved past said supply opening and said material is held between said cavity walls, said movable means, and said bolster, said means for supplying material further including a selectively openable door covering said supply opening and opening to admit material into said cavity.

2. The baling press of claim 1 in which said supply opening is positioned such that substantial compression of said material does not occur until said bolster has moved past said supply opening so that said door covering said supply opening is not subjected to forces produced by said bolster during compression of said material.

* * * * *